United States Patent [19]

Cremona

[11] Patent Number: 5,031,677

[45] Date of Patent: Jul. 16, 1991

[54] VENEER CUTTING MACHINE FOR TREE TRUNKS WITH VARIABLE RAKE

[75] Inventor: Lorenzo Cremona, Monza, Italy

[73] Assignee: Angelo Cremona & Figlio S.p.A., Milan, Italy

[21] Appl. No.: 524,438

[22] Filed: May 17, 1990

[30] Foreign Application Priority Data

May 19, 1989 [IT] Italy ..... 21104/89[U]

[51] Int. Cl.[5] ..... B27L 5/02

[52] U.S. Cl. ..... 144/212; 144/211

[58] Field of Search ..... 144/209 R, 211, 212

[56] References Cited

U.S. PATENT DOCUMENTS 3,473,584 10/1969 Reed ..... 144/212

4,753,278 6/1988 Lorenzo ..... 144/212

*Primary Examiner*—W. Donald Bray

*Attorney, Agent, or Firm*—Finnegan, Henderson, Farabow, Garrett & Dunner

[57] ABSTRACT

A rotary veneer-cutting machine for cutting sheets of veneer from tree trunks comprises a bladeholder unit (19) moving on a pair of support elements (21, 23) along guides (23) for drawing a blade (16) toward the axis of the trunk (14). Said support elements (21, 23) in addition to moving along guides (23) also move independently in a direction virtually perpendicular to the guides (23) to incline and displace the blade (16) in relation to the diametrical plane of the trunk (14). Support element (21) is located virtually in a plane perpendicular to the guides (23) that passes through the edge of the blade (16) and the other support (22) in a position which is remote from said plane.

3 Claims, 2 Drawing Sheets

VENEER CUTTING MACHINE FOR TREE TRUNKS WITH VARIABLE RAKE

BACKGROUND OF THE INVENTION

This invention relates to a veneer cutting machine for tree trunks with variable rake.

As is well known to those skilled in the art, in cutting veneer from trunks a very important parameter for obtaining a good result is the cutting rake of the veneer cutting machine blade, i.e. the angle formed by the plane of the blade in contact with the trunk with the plane tangent to the cylinder constituted by the trunk along the generating line coinciding with the blade edge.

Said angle, hereinafter indicated for simplicity by $\alpha$, must be established on the basis of the characteristics of the tree species to be veneercut, the heat treatment and the degree of seasoning undergone thereby, and the various other parameters such as trunk diameter which affect the veneer cutting operation.

Dependence on trunk diameter is very important because it is a parameter which varies continuously during veneer cutting. The reason for such dependence is the fact that, to remove from the trunk a continuous strip or even detached sheets of veneer with predetermined, constant thickness, the veneer must be compressed between the point of the blade which performs the cutting and an edge of a special prismatic bar (termeed 'torsion bar') which is positioned near the blade and has the function of stabilizing the penetration of the blade into the wood at the point of separation from the body of the trunk. But the forces generated by compression of the veneer tend to deflect the point of the blade toward the trunk, which must find support in contact therewith, to prevent vibrations which would have a negative effect on the thickness and surface quality of the veneer.

Said support function is obtained by contact on the surface of the trunk of a portion, as long as the trunk and a few millimeters wide, of the side of the blade near the edge thereof.

The need for uniform quality and thickness of the veneer requires that the part of the blade in contact with the trunk remain as much as possible of uniform dimensions and close to those which give minimal vibrations. Contrarywise, if the blade should hold inclination angle $\alpha$ constant, as the veneer cutting proceeded and consequently the curvature of the trunk increased there would be a decrease in the area of contact between the blade and the trunk.

To avoid this the angle $\alpha$ must therefore vary with the trunk diameter. Assuming that the veneer cut trunk maintains its cylindrical shape even near the blade contact point, the mathematical relation between radius R of the trunk, angle $\alpha$ and the width "a" of the contact area will be:

$$\alpha = -\arcsin (a/2R)$$

But in practice the elasticity of the wood causes distortion thereof in the blade contact area, a distortion which causes an increase of the contact area proportionate to the trunk diameter.

To correct this deviation from the theoretical value given by the above formula, the angle $\alpha$, always negative therein, must be made positive for a large R and a negative values below a certain value Ro at which $\alpha=0$ so as to obtain an effective virtual uniformity of the value of "a" according to R. This requires that the law of change of $\alpha$ be in practice:

$$\alpha = \alpha_0 - \arcsin (a/2R)$$

where $\alpha_0 = \arcsin (a/2R_0)$.

Thus, mechanisms which in accordance with said law continually and automatically adjust the rake according to the diameter of the trunk being processed have been developed in the known art.

One solution in the known art provides that the blade and pressure bar be mounted on a support moving along appropriately shaped guides so that according to the decrease in the diameter of the trunk the support rotates around the axis passing through the blade edge and causing $\alpha$ to change in accordance with the formula last written above. In addition, a second group of adjustable guides makes it possible to set the minimum and maximum values of $\alpha$ for the minimum and maximum values of the radius R so as to be able to adapt the machine for processing woods with different characteristics.

But such a system requires a group of guides with relatively complex operation and is therefore costly and also is not always simple to regulate.

SUMMARY OF THE INVENTION

The general object of the present invention is to provide a veneer cutting machine with a blade holder unit which, in the movement of the blade toward the center of the trunk, will follow the desired law of change of $\alpha$ and allow ready regulation of the parameters which define it. In view of said object there is provided, in accordance with the invention, a rotary veneer cutting machine for cutting sheets of veneer from tree trunks comprising a blade holder unit mounted on a pair of support elements that move along guides for drawing the blade toward the axis of the trunk and characterized in that said support elements, in addition to moving along said guides, also move independently, by means of adjustment means, in a direction virtually at a right angle to the guides for inclining and moving the blade in relation to the plane diametral of the trunk, one of said support elements being located virtually in a plane perpendicular to the guides that passes through the blade's edge and the other in a position remote from said plane.

BRIEF DESCRIPTION OF THE DRAWINGS

To clarify the explanation of the innovative principles of the present invention and its benefits in comparison with the known art there is described below with the help of the annexed drawings a possible embodiment thereof as an example applying said principles. In the drawings

DETAILED DESCRIPTION OF THE INVENTION

Figure 1:
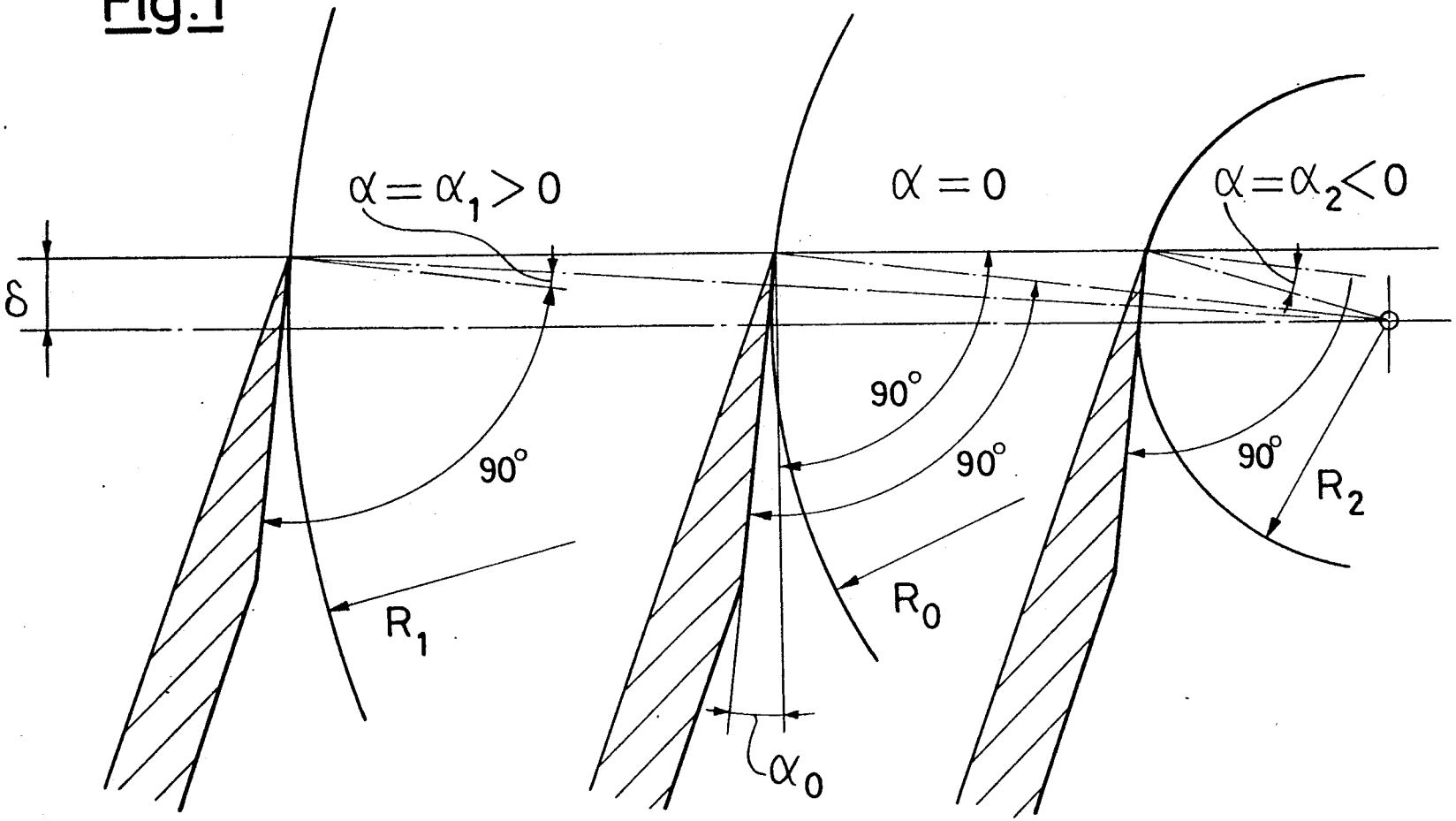
FIG. 1 shows schematically the position of the blade relative to a trunk in three phases of the veneer cutting process.

With reference to the figures, in FIG. 1 is shown the change of the rake or angle $\alpha$ in relation with that of radius R of the trunk determined by parameters $\delta$ and $\alpha_0$. This variation follows the law which compensates for the effects of distortion of the wood in the blade contact area, a distortion which, as already mentioned, tends to decrease with the decrease in the trunk diameter. Adjustment of the inclination $\alpha_0$ of the blade in relation to the direction at a right angle to that of feed permits establishing the value of $R_0$ at which $\alpha=0$ and thus have positive $\alpha$ for radii greater than $R_0$ and negative $\alpha$ for radii smaller than $R_0$.

Figure 2:
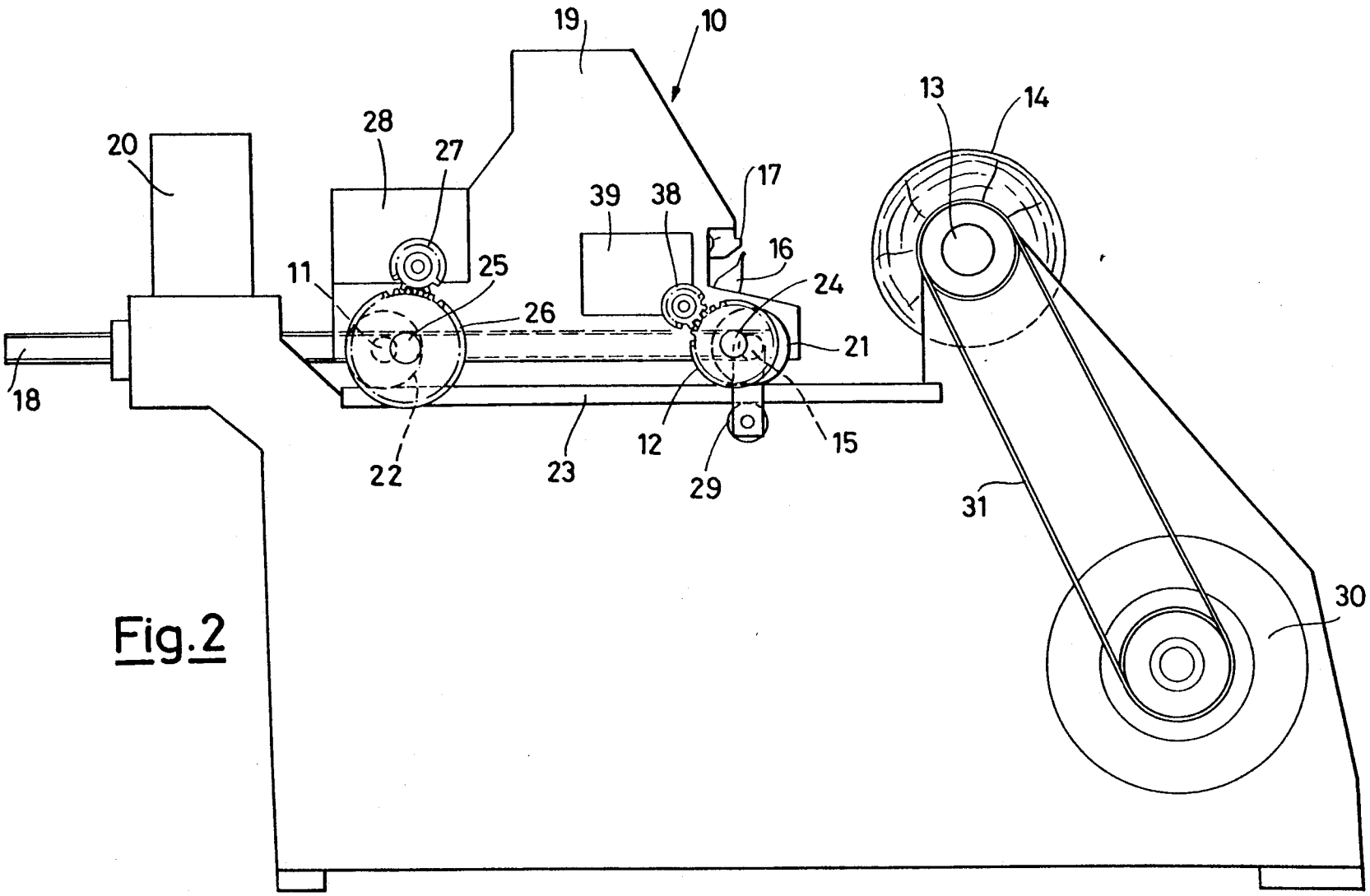
FIG. 2 shows a schematic side elevation of a veneer cutting machine embodied in accordance with the present invention.

The abovementioned known practical law is thus satisfied. To obtain this regulation of $\delta$ and $\alpha_0$ in accordance with the invention and as shown in FIG. 2, a machine for cutting veneer from a trunk 14 comprises a frame 50 having rotating means for rotatably supporting the trunk and comprising chucks 13 driven by means of a drive belt 31 operated by a motor 30. A carriage generally indicated by reference number 10 is mounted on frame 50 and consists of a structure 19 bearing a blade 16 and a bucking bar 17 in positions mutually adjustable by the known art. Said carriage slides on guides 23 to draw near the rotation axis of the trunk between the chucks by means of rear wheels 22 and front wheels 21 with lower check wheels 29.

Traversing of the carriage along the guides 23 is controlled by a ratiomotor 20 which acts on a worm screw 18 with one end connected to the front of the carriage bearing the wheels 21.

The rear wheels 22 have their axle 11 fixed with respect to an eccentric adjusting axle 25 of a gear 26 coupled to a pinion 27 keyed to the output shaft of a drive ratiomotor 28.

Similarly, the front wheels 21 have their rotation axis 15 fixed with respect to an eccentric axle 24 of a second gear 12 coupled to a pinion 38 keyed to the output shaft of a second drive ratiomotor 39.

Advantageously the axle 24 is located near the plane which passes through the blade edge and perpendicular to the rolling plane of the wheels, i.e. in the direction of travel of the blade.

The axle 25 is advantageously located remote from said plane. Operation of the ratiomotor 28 rotates the blade holding structure 19 around the axle 15 while operation of the ratiomotor 39 rotates the structure around the axle 11.

As will be clear to the technician, with simple geometrical measurements, because of the relative positions between the blade edge and the axles 11 and 15, the arc travelled by the blade around the axle 11 can be approximated, with a virtually straight vertical line by small movements along it without large errors.

Similarly, for small movements of the blade along the arc around the axle 15 said arc can be approximated with a straight horizontal line.

In this manner operation of the ratiomotor 39 changes practically only the distance previously called $\delta$ while operation of the ratiomotor 28 changes practically only the angle previously called $\alpha_0$.

As a result of this virtual independence it is easy to regulate the machine.

It would even be possible to connect the two motors to an automatic control system of the known art and it would be readily apparent to one skilled in the art how to change continuously the values of $\delta$ and $\alpha_0$ during the entire process of veneer cutting of a trunk to embody any law of change of $\alpha$ considered necessary.

The distances between the axles of the wheels and their respective eccentric axles supplies the highest module values obtainable for the adjustments.

Naturally the above description is given as an example of the innovative principles claimed herein and is therefore not to be considered as a limitation of the scope of the invention claimed herein.

For example, since the value of $\alpha$ usually requires recording only once, the motor 39 could be replaced by a manual adjustment mechanism.

In addition, the support elements for the guides, described here as wheels, could obviously be embodied with other sliding elements, e.g. sliding blocks.

Finally, the parts of a veneer cutting machine otherwise known are shown in the drawings and briefly described to facilitate understanding but it is understood that said parts can be embodied in any form of the known art.

I claim:

1. A rotary veneer cutting machine for cutting sheets of veneer from tree trunks comprising a frame, rotating means mounted on said frame for rotatably supporting the truck to be cut, longitudinal guides mounted on said frame, a carriage support for movement along said guides by a pair of spaced front and rear support elements, said front element being positioned toward said tree trunk and said rear support element being positioned away from said tree trunk, a blade mounted on said carriage having a cutting edge parallel to the axis of rotation of the trunk, means for moving the carriage and the blade forward and backward along said guides to bring the blade into contact with the trunk for cutting sheets of veneers therefrom, and means for moving each of said support elements independently of each other in a direction substantially perpendicular to the longitudinal length of the guides for inclining and moving the carriage and the blade in relation to a plane and parallel to the guides that passes through the axis of trunk, the front support element being located in a plane perpendicular to the guides that passes substantially through the blade's edge and the rear support element being located remote therefrom.

2. The veneer cutting machine of claim 1, wherein the front and rear support elements are a pair of front and rear wheels rotatably mounted about a respective axis for movement along said guides, the axis of each of said wheels being fixed eccentrically with respect to the axis of an associate adjusting gear that is mounted for rotation about an axis on the carriage, and means for rotating said adjusting gears, whereby rotation of the adjusting gear of one of the wheels rotates the carriage and the blade around the axis of the other of said wheels.

3. The veneer cutting machine of claim 2, wherein the means for rotating the adjusting gears comprises a pinion gear coupled to the adjusting gear and keyed to an electric ratiomotor.

* * * * *